United States Patent [19]

Matsushiro

[11] Patent Number: 4,579,544

[45] Date of Patent: Apr. 1, 1986

[54] MOTOR-DRIVEN MOVABLE TOY

[75] Inventor: Yukimitsu Matsushiro, Tokyo, Japan

[73] Assignee: Kabushiki Kaisha Matsushiro, Tokyo, Japan

[21] Appl. No.: 548,306

[22] Filed: Nov. 3, 1983

[30] Foreign Application Priority Data

Sep. 14, 1983 [JP] Japan ..... 58-143182[U]

[51] Int. Cl.[4] ..... A63H 17/12

[52] U.S. Cl. ..... 446/427; 74/15.4

[58] Field of Search ..... 446/424, 425, 426, 427, 446/428; 74/15.4

[56] References Cited

U.S. PATENT DOCUMENTS

| | | | |
|---|---|---|---|
| 1,515,948 | 11/1924 | Hammond, Jr. . | |
| 3,475,854 | 11/1969 | Ryan et al. . | |
| 3,529,479 | 2/1967 | Ryan et al. | 74/15.4 |
| 4,273,001 | 6/1981 | Miyahara et al. | 74/15.4 X |
| 4,479,327 | 10/1984 | Wakimura | 446/427 |

FOREIGN PATENT DOCUMENTS

| | | |
|---|---|---|
| 1049755 | 1/1959 | Fed. Rep. of Germany . |
| 1203651 | 10/1965 | Fed. Rep. of Germany . |
| 1963096 | 12/1970 | Fed. Rep. of Germany . |
| 389293 | 3/1933 | United Kingdom . |
| 728367 | 4/1955 | United Kingdom . |
| 751232 | 6/1956 | United Kingdom . |
| 1340823 | 12/1973 | United Kingdom . |
| 2031287 | 4/1980 | United Kingdom . |

*Primary Examiner*—F. Barry Shay

*Attorney, Agent, or Firm*—Lowe, King, Price & Becker

[57] ABSTRACT

In a motor-driven movable toy vehicle, a single motor is used in common for driving the toy vehicle body at a high speed or a low speed and a winch mechanism. To select one of the driving modes, a selector lever is so arranged as to shift a slide gear assembly. Additionally, a power releasing mechanism is provided for the winch mechanism for preventing toy parts from being damaged when a winch wire is excessively rolled up.

5 Claims, 8 Drawing Figures

MOTOR-DRIVEN MOVABLE TOY

BACKGROUND OF THE INVENTION

1. Field of the Invention

The present invention relates generally to a motor-driven movable toy and more specifically to a motor-driven movable toy vehicle in which a single motor is used for driving the toy vehicle as well as a winch mechanism installed therewithin.

2. Description of the Prior Art

Various motor-driven movable toys are known, such as automotive vehicle toys which can run on a floor, or toy ships which can move on the surface of water. However, in these toys of which I am aware, a single motor is used only for driving the toy. When these toys are provided with other auxiliary mechanisms such as a winch mechanism, another motor is usually provided in addition to the motor for driving the toy itself. Therefore, there exists a problem in that a plurality of motors are needed, the power consumption rate is great, and a large space is necessary, in the case when an additional auxiliary mechanism is provided for a motor-driven movable toy, thus resulting in an increase in manufacturing cost and volume of the toy.

SUMMARY OF THE INVENTION

With these problems in mind, therefore, it is the primary object of the present invention to provide a motor-driven movable toy in which a single motor is used for both driving the toy itself and an additional auxiliary mechanism, such as winch mechanism.

To achieve the above-mentioned object, the motor-driven movable toy according to the present invention comprises a single motor, a selector lever for selecting one of toy driving operation and winch mechanism driving operation, and a slide gear assembly selectively movable for transmitting motive power to one of the toy driving mechanism and the winch mechanism.

Additionally, in the motor-driven movable toy according to the present invention, since winch driving power releasing means is provided for releasing the motor power from the winch mechanism, it is possible to prevent the parts from being damaged even if a winch wire is excessively rolled up.

BRIEF DESCRIPTION OF THE DRAWINGS

The features and advantages of the motor-driven movable toy according to the present invention will be more clearly appreciated from the following description taken in conjunction with the accompanying drawings in which like reference numerals designate corresponding elements or sections in which.

DETAILED DESCRIPTION OF THE PREFERRED EMBODIMENTS

In view of the above description, reference is now made to a preferred embodiment of the motor driven movable toy vehicle of remote-control type according to the present invention.

Figure 1:
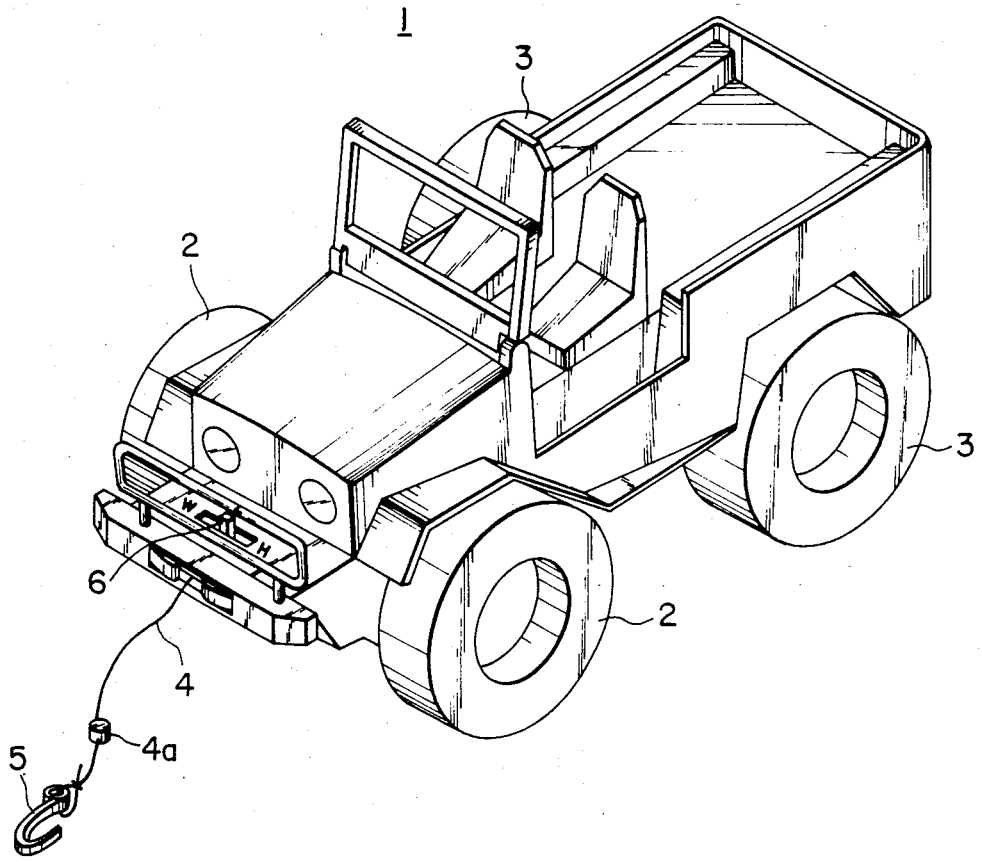
FIG. 1 is a perspective view showing an exemplary motor-driven movable toy automotive-vehicle provided with a winch mechanism according to the present invention.

With reference to FIG. 1, a toy vehicle 1 includes a pair of front wheels 2 and a pair of rear wheels 3. The reference numeral 4 denotes a winch wire having a hook 5 fixed at the end of the wire and a stopper 4*a* fixed near the end thereof. The reference numeral 6 denotes a selector lever. When this selector lever 6 is set to "W", the winch wire 4 is rolled up or out; when set to "H", the toy vehicle runs forward or rearward at a high speed; when set to "L", the toy vehicle runs forward or rearward at a low speed. The direction of winch wire rolling-up or rolling-out or toy vehicle forward running or rearward running are determined in dependence upon the direction of rotation of a motor installed within a body of the toy vehicle 1. In more detail, a receiving circuit unit is installed within the toy vehicle and a transmitting circuit unit is installed within a remote control box. When a reverse switch on the remote control box is depressed by the operator, the motor rotates reversely to drive the toy vehicle in the rearward direction or the winch mechanism in the direction that the winch wire is rolled out. When a normal switch on the remote control box is depressed by the driver, the motor rotates normally to drive the toy vehicle in the forward direction or the winch mechanism in the direction that the winch wire is rolled up.

The toy vehicle according to the present invention is roughly made up of a selector lever, a motor, a driving gear mechanism, a differential gear casing, a slidable gear assembly, a winch mechanism and a winch driving power releasing mechanism (slidable frame), which are all housed within the front portion of the toy vehicle 1.

Figure 2:
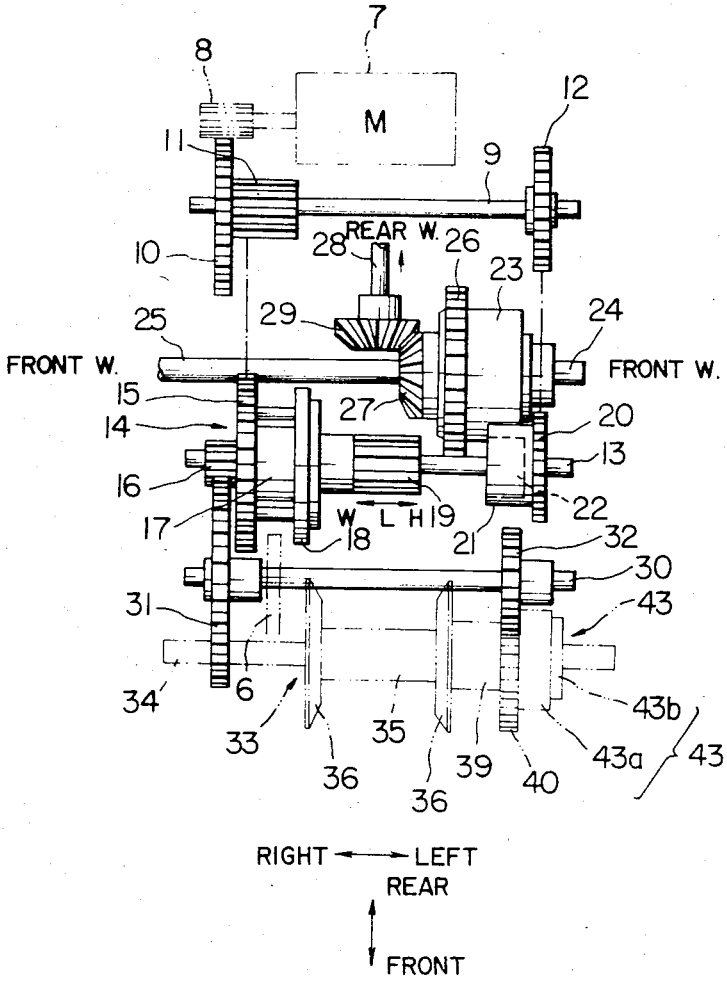
FIG. 2 is a plan view, partly exploded view, showing the power-transmitting mechanism or the gear train of the motor-driven movable toy vehicle according to the present invention shown in FIG. 1.
Figure 3:
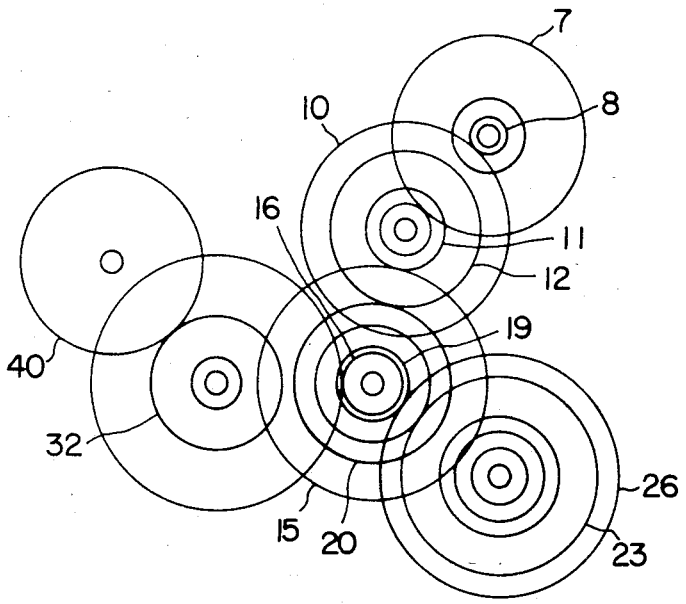
FIG. 3 is a side view diagrammatically showing the gear train of the toy vehicle according to the present invention shown in FIG. 2.

With reference to FIGS. 2 and 3, the driving gear mechanism or a gear train made up of a plurality of gears and the slidable gear assembly will be described hereinbelow.

FIG. 2 is a plan view (partly exploded) of the gear train and the slidable gear assembly when seen from the top of the vehicle. Therefore, it should be noted that in the following description, the front side of the toy vehicle corresponds to the lower side in FIG. 2, the rear side of the toy vehicle corresponds to the upper side in FIG. 2, the left side of the toy vehicle in the advancing direction corresponds to the right side in FIG. 2 and the right side of the vehicle corresponds to the left side in FIG. 2. The above applies to FIGS. 4, 5, 6, and 7, as well.

In FIG. 2, the reference numeral 7 denotes a motor. A drive pinion gear 8 is fixed to a driven shaft of the motor 7. This drive pinion gear 8 engages with a spur gear 10 fixed to a drive shaft 9 rotatably supported by the toy vehicle body. On the left side of the drive shaft 9, another spur gear 12 is fixed; on the right side of the drive shaft 9, a pinion gear 10 is formed integrally with the spur gear 11.

In parallel with the drive shaft 9, a slide gear shaft 13 is rotatably supported by the vehicle body for installing a slide gear assembly 14. The slide gear assembly 14 includes a spur gear 15 selectively engageable with the pinion gear 11, a pinion gear 16, a cylindrical portion 17, a disc portion 18, and another pinion gear 19, which are all formed integrally. The slide gear assembly 14 is rotatably and slidably supported by the slide gear shaft 13. Between the spur gear 15 and the disc portion 18, the selector lever 6 pivotably disposed at the front of the toy vehicle is positioned. Therefore, when the selector lever 6 is moved by the finger, the slide gear assembly 14 is moved right and left along the slide gear shaft 13. Additionally, a spur gear 20 is fixed to the slide gear shaft 13 at the leftmost side thereof. This spur gear 20 engages with the spur gear 12 fixed to the drive shaft 9 at all times. On the inside of the spur gear 20, a cylindrical member 21 is formed integrally with the spur gear 20. An inner gear 22 is formed within the cylindrical member 21 so as to be engageable with the pinion gear 19.

On the other hand, a differential gear casing 23 is disposed on the rear side from the slide gear shaft 13. Within this differential gear casing 23, there is housed a well-known differential gear assembly (not shown). On the left side of the differential gear casing 23, a left-hand front wheel shaft 24 is rotatably supported by the toy vehicle body; on the right side of the differential gear casing 23, a right-hand front wheel shaft 25 is also rotatably supported by the toy vehicle. A spur gear 26 and a bevel gear 27 are formed integrally with the differential gear casing 23. The spur gear 26 selectively engages with the pinion gear 19, and the bevel gear 27 engages at all times with another bevel gear 29 fixed at the end portion of a propeller shaft 28. Therefore, when the spur gear 26 rotates, the propeller shaft 28 is driven through the two bevel gears 27 and 29 in order to drive the rear wheels (not shown).

Additionally, a winch drive shaft 30 is rotatably supported by the toy vehicle body on the front side from and in parallel with the slide gear shaft 13. At the left side of the winch drive shaft 30, a spur gear 32 having a small number of teeth is fixed; at the right side of the winch drive shaft 30, another spur gear 31 having a great number of teeth is fixed so as to be selectively engageable with the pinion gear 16 of the slide gear assembly 14.

Furthermore, a winch drive shaft 34 is rotatably supported by the toy vehicle body on the front side from and in parallel with the winch drive shaft 30 in order to install a winch mechanism 33 (described later in more detail). The winch drive shaft 34 is driven by a winch drive spur gear 40 engaged with the spur gear 32 fixed to the winch drive shaft 30.

The operation of the driving gear mechanism and the selector lever will be described herein below.

When a power switch (not shown) is turned on, the motor 7 begins to rotate, so that the drive pinion gear 8 also rotates to drive the drive shaft 9 through the spur gear 10. This motor rotational power is transmitted to the slide gear shaft 13 through the spur gear 12 fixed to the drive shaft 9 and the spur gear 20 fixed to the slide gear shaft 13. Therefore, while the motor 7 is rotating, the drive shaft 9 and the slide gear shaft 13 are both continuously rotating, in order to drive the toy vehicle body and the winch mechanism.

(1) When the selector lever 6 is set to "H" (high speed):

The slide gear assembly 14 is shifted to the leftmost position (rightmost position in FIG. 2), so that the pinion gear 19 is inserted into the cylindrical member 21. Therefore, the pinion gear 19 is engaged with the inner gear 22 of the cylindrical member and simultaneously with the spur gear 26 formed integrally with the differential gear casing 23. In this case, the pinion gear 16 of the slide gear assembly 14 is disengaged from the spur gear 31 fixed to the winch drive shaft 32 and, simultaneously, the spur gear 15 of the slide gear assembly 14 is disengaged from the pinion gear 11 fixed to the drive shaft 9.

Accordingly, the motor driving power is transmitted from the motor 7 to the differential gear case 23 by way of the drive pinion gear 8, the spur gear 10, the drive shaft 9, the spur gear 12, the spur gear 20, the inner gear 22, the pinion gear 19, and the spur gear 26. Since the ratio of the number of teeth of the spur gear 12 to the number of teeth of the spur gear 20 is relatively great, the differential gear casing 23 is rotated at a relatively high speed to drive the toy vehicle at a high speed. When the differential gear casing 23 rotates, both the front wheel shafts 24 and 25 are driven and the propeller shaft 28 is also driven via the two bevel gears 27 and 29 to drive the two rear wheels 3 shown in FIG. 1.

In this case, since the receive circuit unit (not shown) is housed within the toy vehicle body and the transmit circuit unit (not shown) is housed within a remote control box (not shown), it is possible to drive the toy vehicle frontwards or rearwards by rotating the motor 7 in the normal or reverse direction in response to the control command signals transmitted from the remote control box.

(2) When the selector lever 6 is set to "L" (low speed):

The slide gear assembly 14 is shifted to the middle position (rightward side in FIG. 2), so that the pinion gear 19 of the slide gear assembly 14 is engaged with only the spur gear 26 formed integrally with the differential gear case 23 without being engaged with the inner gear 22. At the same time, the spur gear 15 of the slide gear assembly 14 is still kept engaged with the pinion gear 11 fixed to the drive shaft 9. In this case, the pinion gear 16 of the slide gear assembly 14 is disengaged from the spur gear 31 fixed to the winch drive shaft 32.

Accordingly, the motive power is transmitted from the motor 7 to the differential gear case 23 by way of the drive pinion gear 8, the spur gear 10, the pinion gear 11, the spur gear 15, the slide gear assembly 14, with its pinion gear 19 and the spur gear 26. Since the ratio of the number of teeth of the pinion gear 11 to the number of teeth of the spur gear 15 is relatively small as compared with that of the spur gear 12 to the spur gear 20, the differential gear casing 23 is rotated at a relatively low speed to drive the toy vehicle at a low speed. When the differential gear casing 23 rotates, both the front wheel shafts 24 and 25 are driven and the propeller shaft 28 is also driven via the two bevel gears 27 and 29 to drive the two rear wheels 3 shown in FIG. 1. Similarly to the case of "High Speed", the toy vehicle body is driven frontwards or rearwards by rotating the motor 7 in the normal or reverse direction.

(3) When the selector lever 6 is set to "W" (winch):

The slide gear assembly 14 is shifted to the rightmost position (leftmost position in FIG. 2) as shown in FIG. 2, so that the pinion gear 19 is disengaged from the spur gear 26 formed integrally with the differential gear casing 23 but the pinion gear 16 is engaged with the spur gear 31 fixed to the winch drive shaft 30 with the spur gear 15 of the slide gear assembly 14 kept engaged with the pinion gear 11 fixed to the drive shaft 9.

Accordingly, the motor driving power is transmitted from the motor 7 to the winch mechanism 33 by way of the drive pinion gear 8, the spur gear 10, the pinion 11, the spur gear 15, the pinion gear 16, the spur gear 31, the winch drive shaft 30, the spur gear 32 and the winch drive spur gear 40. Since the ratio of the number of teeth of the pinion gear 16 to the number of teeth of the spur gear 31 is the smallest, the winch drive shaft 30 is rotated at a lowest speed to drive the winch mechanism 33. As understood later, when the winch mechanism rotates, the winch wire 4 is rolled up or out by rotating the motor 7 in the normal or reverse direction in response to the control command signals transmitted from the remote control box.

With reference to FIGS. 4 to 8, the winch mechanism 33 and a power transmission releasing mechanism 50 (slidable frame) will be described hereinbelow.

The winch mechanism 33 is made up of a hexagonal shaft 34 movable in the axial direction thereof, a winch drum 35 with a hexagonal central hole so as to be rotatable together with the hexagonal shaft, a pair of mounted brackets 38 fixed to the vehicle body in position, a cylindrical member 39 movable along and rotatable about the hexagonal shaft 34, a winch drive spur gear member 40 with a hexagonal central hole so as to be movable along and rotatable together with the hexagonal shaft 34, a pair of rear-side and front-side control members 44 and 45 slidable in the direction perpendicular to the hexagonal shaft 34 (the rear-side control member 44 is fixed), a pair of slidable bearing members 47 and 48 slidable together with the hexagonal shaft 34, a projection member 49 fixed to the righthand bearing members 47, and two helical springs 42 and 46.

Figure 5:
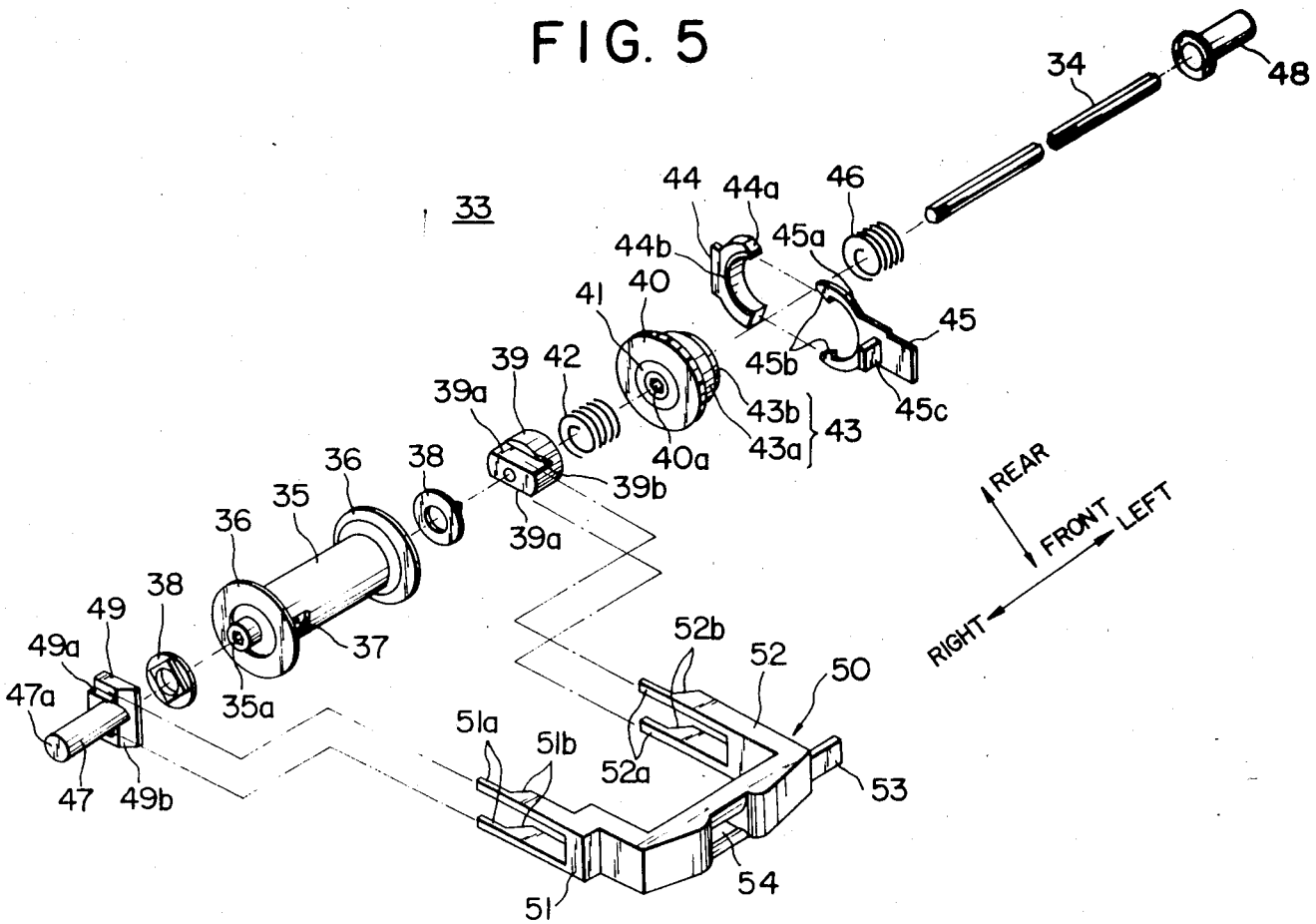
FIG. 5 is an exploded view showing the winch mechanism and the winch driving power releasing mechanism both shown in FIG. 4.

The entire winch mechanism 33 is supported by two mounting brackets 38 fixed to the vehicle body. In addition, the hexagonal shaft 34 is slidably supported by two slidable bearing members 47 and 48 supported by the vehicle body at both the end portions thereof. As depicted in FIG. 5, the central holes of these bearing members are circular in shape and the central holes of the winch drum 35 and the winch drive spur gear member 40 are hexagonal in shape. The hexagonal shaft 34 is passed through the central hexagonal hole 35*a* of the winch drum 35 and the central hexagonal hole 40*a* of the winch drive spur gear member 40. Therefore, the winch drum 35 and the winch drive spur gear member 40 are slidable along the hexagonal shaft 34 and rotatable together with the shaft 34. The winch drum 35 is formed with a pair of flange portions 36 on both the end thereof. A projection 37 having a hole through which the end of the winch wire 4 is passed and fixed is formed on the inner side of the right-hand flange 36 of the winch drum 35. A pair of mounting brackets 38 are arranged so as to sandwich the winch drum 35.

The cylindrical member 39 is disposed on the left-hand side of the winch drum 35 and on the outside of the mounting bracket 38 so as to be rotatable about the hexagonal shaft 34. The cylindrical member 39 is formed with a pair of upper and lower D-shaped cutouts 39*a* in parallel with each other on the surface facing the winch drum 35. A cutout slope 39*b* is formed extending outwards from one edge of each of the two D-shaped cutouts 39*a*, in symmetry with the center of the cylindrical member 39.

On the outside of the cylindrical member 39, the winch drive gear member 40 having a hexagonal central hole is disposed coaxially with the hexagonal shaft 34. Therefore, the winch drive gear member 40 is slidable along the hexagonal shaft 34 but not rotatable about the hexagonal shaft 34. On the inner end surface of the winch drive gear member 40, an annular groove 41 is formed facing the winch drum 35. In the cylindrical member 39, a cylindrical hollow cavity is formed facing the gear member 40. A spring 42 is disposed between the inner cylindrical hollow cavity of the cylindrical member 39 and the annular groove 41 of the gear member 40 so as to urge the winch drive gear member 40 outwards or to urge the cylindrical member 39 inwards. As already described, this winch drive gear member 40 is located in place so as to engage with the spur gear 32 fixed to the winch drive shaft 30 (shown in FIG. 2). The winch drive gear member 40 is formed with two-stage cylindrical portions 43 made up of a larger-diameter cylindrical portion 43*a* and a smaller-diameter cylindrical portion 43*b*.

On the outside of the winch drive gear member 40, a semicircular rear-side control member 44 and a semicircular front-side control member 45 are arranged. The semicircular rear-side control member 44 is formed with a slope 44*a* on either end thereof and a semicircular projection 44*b* along the inner periphery thereof on the winch drive gear member side. The inner diameter of the semicircle of this rear-side control member 44 is a little smaller than that of the larger-diameter portion 43*a* of the winch drive gear 40 but a little greater than that of the smaller-diameter portion 43*b* of the winch drive gear 40.

The semicircular front-side control member 45 is formed with a pair of bendable arms 45*a*. At either end portion of the bendable arms 45*a*, a claw 45*b* is formed at such a position as to be in contact with the slope 44*a* of the semicircular rear-side control member 44, respectively. Similarly, the inner diameter of the semicircle of this front-side control member 45 is a little smaller than that of the larger-diameter portion 43*a* of the winch drive gear member 40 but a little greater than that of the smaller-diameter portion 43*b* of the winch drive gear member 40. The inner distance between the two claws 45*b* is much smaller than that of the smaller-diameter portion 43*b* of the winch drive gear member 40. Additionally, a cubic projection 45*c* is formed on one surface of the front-side control member 45 facing the winch drive gear 40. The thickness of the rear-side control member 44 is greater than that of the front-side control member 45. Therefore, when the thin front-side control member 45 is urged toward the thick rear-side control member 44 with the claw slopes 45*b* in contact with the slopes 44*a*, the arms 45*a* of the front-side control member 45 are expanded outwards.

These two rear- and front-side control members 44 and 45 are opposingly disposed, as dipicted in FIG. 5. The rear-side control member 44 is fixed to the vehicle body and the front-side control member 45 is supported by the vehicle body in such a way as to be slidable back and forth and that the claw slopes 45*b* are in contact with the slopes 44*a* of the rear-side control member 44. Therefore, when the front-side control member 45 is not urged toward the rear-side control member 44, the claw slopes 45*b* are positioned in slight contact with the slopes 44*a*. In this state, the side surface of each claw 45*b* is in contact with the smaller-diameter portion 43*b* of the winch drive gear member 40, so that the outward movement of the winch drive gear member 40 due to the urging force of the spring 42 is inhibited.

In contrast with this, when the front-side control member 45 is urged toward the rear-side control member 44, the claw slopes 45*b* are positioned in pressure contact with the slopes 44*a*, being expanded in the outward direction. In this state, the side surface of each claw 45*b* is out of contact with the smaller-diameter portion 43*b* of the winch drive gear member 40, so that the winch drive gear member 40 is shifted in the leftward axial direction of the hexagonal shaft 34 by the urging force of the spring 42.

In addition, a spring 46 is disposed between the outer surface of the smaller-diameter portion 43*b* of the winch drive gear member 40 and the lefthand slidable bearing member 48 to urge the entire winch mechanism 33 in the rightward direction.

The hexagonal shaft 34 is rotatably supported by each cylindrical hole of the two slidable bearing members 47 and 48 supported by the toy vehicle body.

Further, a square member 49 is formed integrally with the righthand slidable bearing member 47. In this square member 49, two cutouts 49*a* are formed on the upper and the lower sides thereof and a pawl 49*b* is formed on the front side thereof. These two slidable bearing members 47 and 48 can slide together with the hexagonal shaft 34 in the axial direction thereof.

The power transmission releasing mechanism 50 is a U-shaped slidable frame having two left and right arms 51 and 52, as depicted in FIG. 5. The two arms 51 and 52 are bifurcated into two upper and lower projections 51*a* and 52*a* on either side thereof. Near the end portion of each bifurcated projection 51*a* or 52*b*, two righthand slopes 51*b* and two lefthand slopes 52*b* are formed asymmetrically, respectively, extending toward only the left side of the toy vehicle. The righthand two upper and lower projections 51*a* are disposed so as to sandwich the two cutouts 49*a* of the square member 49 formed integrally with the righthand slidable bearing member 47 and the righthand two upper and lower slopes 51*b* are disposed so as to be in contact with the slope surface of the pawl 49*b* of the square member 49 when the slidable frame 50 is urged toward the hexagonal shaft 34. The lefthand two upper and lower projections 52*a* are disposed so as to sandwich the two D-shaped cutouts 39*a* of the cylindrical member 39 and the lefthand two upper and lower slopes 52*b* are disposed so as to be in contact with the slope surfaces 39*b* of the cylindrical member 39 when the slidable frame 50 is urged toward the hexagonal shaft 34. Further, a projection 53 is formed on one side surface of the slidable frame 50 in such a position as to be in contact with the projection 45*c* of the front-side control member 45.

At the front middle of the slidable frame 50, an aperture 54 is formed through which the winch wire 4 is taken out.

Figure 4:
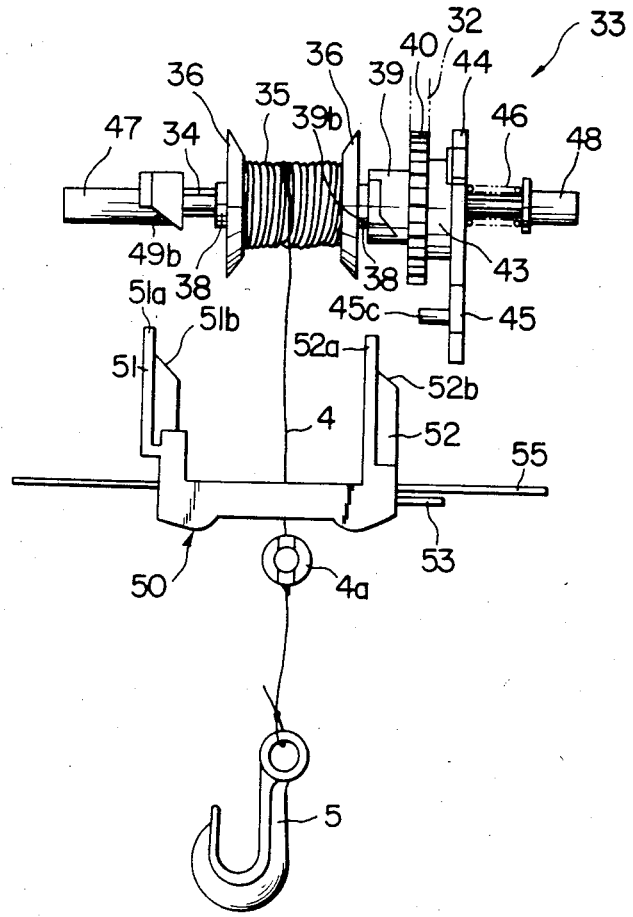
FIG. 4 is a plan view showing the mutual engagement relationship between the winch mechanism and a winch driving power releasing mechanism (slidable frame) of the toy vehicle according to the present invention, in which the slidable frame is shown disengaged from the winch mechanism.

Additionally, a rod spring 55 is provided in parallel with the winch hexagonal shaft 34, as depicted in FIG. 4. This rod spring 55 is supported by the toy vehicle body in place at either end thereof in order to urge the slidable frame 50 in the frontward direction.

The operation of the winch mechanism 33 and the power transmission releasing mechanism (slidable frame) 50 will be described hereinbelow.

Figure 6:
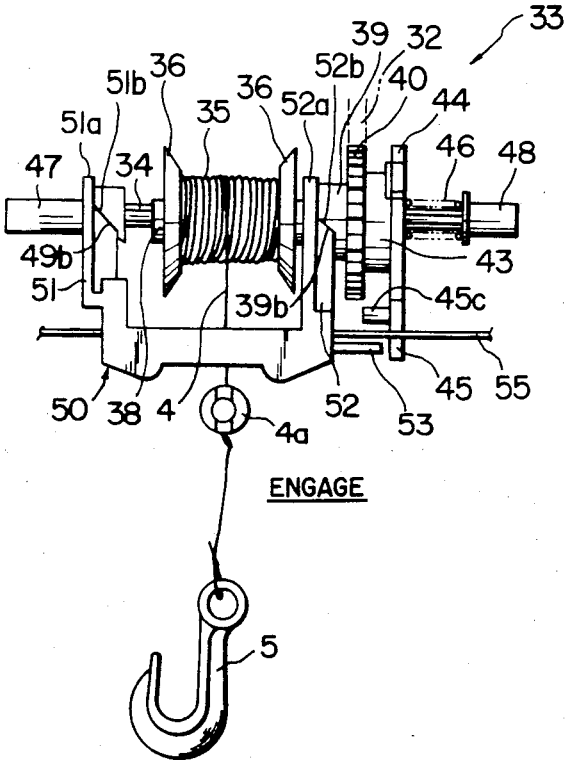
FIG. 6 is a plan view showing the mutual engagement relationship between the winch mechanism and the winch driving power releasing mechanism (slidable frame) in the state where the slidable frame is inoperative.

When the selector lever 6 is set to "W" (winch), the slide gear assembly 14 is shifted to the rightmost position as shown in FIG. 2. Therefore, the motor driving power is transmitted from the motor 7 to the winch mechanism 33 by way of the drive pinion gear 8, the spur gear 10, the pinion 11, the spur gear 15, the pinion gear 16, the spur gear 31, the winch drive shaft 30, the spur gear 32 and the winch drive spur gear member 40. These conditions are depicted in FIG. 4. Since this winch drive spur gear member 40 and the winch drum 35 are both fitted to the hexagonal shaft 34, when the drive spur gear member 40 begins to rotate, the winch drum 35 also begins to rotate to roll up (or roll out) the winch wire 4. As the winch wire 4 is completely rolled up around the winch drum 35, the stopper 4*a* fixed near the hook 5 is brought into contact with the slidable frame 50 and further pushes the slidable frame 50 inwards (upwards in FIGS. 4, 6 and 7) against the elastic force of the rod spring 55. As a result, the slidable frame 50 is brought into contact with the winch mechanism 33 as shown in FIG. 6.

Figure 7:
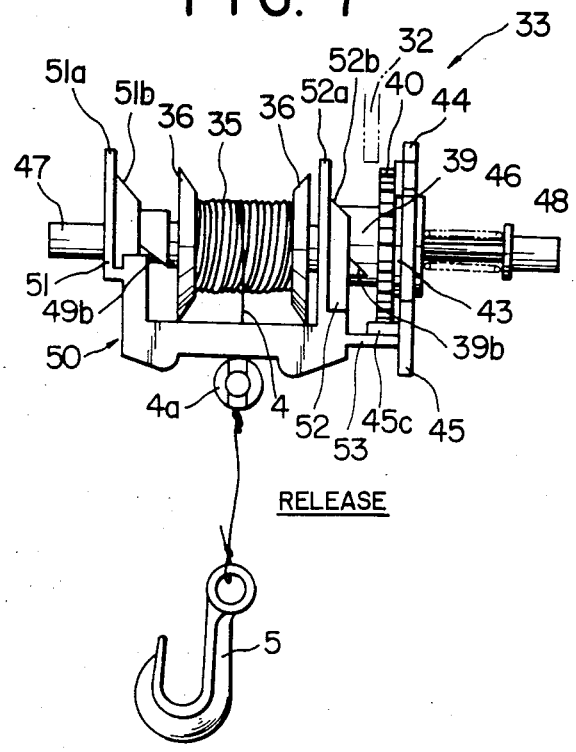
FIG. 7 is a similar plan view showing the mutual engagement relationship between the winch mechanism and the winch driving power releasing mechanism (slidable frame) in the state where the slidable frame is operative.

In more detail, first the two righthand upper and lower projections 51*a* of the slidable frame 50 advance in such a way as to pinch the two cutout portions 49*a* of the square member 49 therebetween; secondly, the two righthand upper and lower slopes 51*b* are brought into contact with the slope surface of the pawl 49*b* of the square member 49; lastly, the two slopes 51*b* run on to the two cutout portions 49*a*, so that the righthand slidable bearing member 47 is moved in the leftward direction (in the rightward direction in the drawings). Since the end surface 47*a* of the bearing member 47 urges the hexagonal shaft 34 at the same time against the elastic force of the spring 46 in the leftward direction, the hexagonal shaft 34 is also shifted as shown in FIG. 7. Simultaneously, first, the two leftward upper and lower projections 52*a* of the slidable frame 50 advance in such a way as to pinch the two D-shaped cutouts 39*a* of the cylindrical member 39 therebetween; secondly, the two lefthand upper and lower slopes 52*b* are brought into contact with the slopes 39*b* of the cylindrical member 39; lastly, the two slopes 52*b* run on to the D-shaped cutouts 39*b*, so that the cylindrical member 39 is moved also in the leftward direction (the rightward direction in the drawing) together with the hexagonal shaft 34 against the elastic force of the spring 46. As a result, the winch drive spur gear member 40 is pushed by the cylindrical member 39 toward the left. In summary, the righthand slopes 51*b* of the slidable frame 50 urges the hexagonal shaft 34; the lefthand slopes 52*b* of the slidable frame 50 urges the cylindrical member 39 both in the leftward direction.

Figure 8:
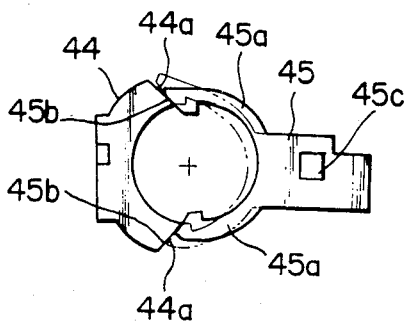
FIG. 8 is a plan view of a pair of front- and rear-side control members assembled in the winch mechanism shown in FIG. 4, in which the winch driving power is released when the front-side control member deforms as shown by the dot-dot-dashed lines.

In addition to the operation described above, when the slidable frame 50 moves toward the winch mechanism 33, the projection 53 formed on the side surface of the slidable frame 50 is also brought into contact with the projection 45*c* of the front-side control member 45 and therefore pushes the front-side control member 45 toward the rear-side control member 44 to such a position that the claw slopes 45*b* of the front-side control member 45 are in contact with the slopes 44*a* of the rear-side control member 44, as depicted by solid lines in FIG. 8. In this state, since the two inner ends of the two claws of the front-side control member 45 are located at such a position that the inner distance between the two claws is smaller than the diameter of the smaller-diameter portion 43*b* of the winch drive spur gear member 40, the winch drive spur gear member 40 cannot move in the leftward direction. However, when the front-side control member 45 is further pushed toward the rear-side control member 44 and therefore the arms 45*a* are expanded outward with the claw slopes 45*b* sliding on the slopes 44*a* of the rear-side control member 44 to such a position as shown by the dot-dot-dashed lines in FIG. 8, the inner distance between the two claws becomes greater than the diameter of the smaller-diameter portion 43*b* of the winch drive spur gear member 40, so that the winch drive gear member 40 is movable in the leftward direction, with the smaller-diameter portion 43*b* passed through the space formed by the two rear- and front-side control members 44 and 45, against the elastic force of the spring 46. Therefore, the winch drive spur gear member 40 is disengaged from the spur gear 32 fixed to the winch drive shaft 30. As a result, no power is transmitted to the winch drive gear member 40, the hexagonal shaft 34, and the winch drum 35. Since the winch drum 35 stops rotating, no tension is applied to the winch wire 4. This state where the winch drum 35 is released from the power is shown in FIG. 7. That is to say, whenever the winch wire 4 is completely rolled up, since the winch drive gear member 40 is released from the spur gear 32 fixed to the winch drive shaft 30, it is possible to prevent the parts from being damaged due to excessive rolling-up tension.

Thereafter, when the motor 7 stops rotating in response to a command signal from the control box, the slidable frame 50 is returned to its original position by the elastic force of the rod spring 55. Therefore, since the leftward-urging force is released from the square member 49 and the cylindrical member 39, the square member 49, the cylindrical member 39 and the winch drive gear member 40, etc. are all returned rightward by the elastic force of the springs 42 and 46 to the original position where the winch drive gear 40 is engaged again with the spur gear 32 fixed to the winch drive gear. Thereafter, when the selector lever 6 is shifted to a position other than "W", it is also possible to roll out the winch wire 4 by the hand, because the winch mechanism 33 released from the gear train.

As described above, in the motor-driven movable toy according to the present invention, since there is provided a selector lever for selecting one of high-speed toy driving operation, low-speed toy driving operation and winch rolling operation, the motor driving power is selectably transmitted to the toy itself and the auxiliary mechanism such as a winch mechanism in response to the position of the selector lever. Thus, it is possible to use a single motor in common for operating the toy in three different operation modes.

Additionally, since there is provided power transmission releasing mechanism (slidable frame) for releasing the motor power from the winch mechanism, it is possible to prevent the parts from being damaged when an excessive power is transmitted to the winch mechanism.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A motor-driven movable toy provided with a toy driving mechanism and a winch mechanism mounted thereon, which comprises in combination:

(a) a toy body having a motor mounted therein;

(b) means mounted in said body connected to said motor for selectively driving said toy at high-speed or low-speed or for driving said winch mechanism, a selector means mounted in said body including a movably mounted selector lever for selecting one of high-speed toy driving operation, low-speed toy driving operation and winch mechanism driving operation;

(c) said driving means further including:

(i) a drive shaft driven by said motor;

(ii) a slide shaft having a slide gear assembly connected to said selector lever for selective movement in opposite directions in response to movement of said selector lever, for selectively transmitting motive power to one of the toy driving mechanism and the winch mechanism;

(iii) differential gearing means mounted on a shaft and driven by said drive shaft through said slide gear assembly and operatively connected to rotate front and rear wheels of said toy in response to movement of said slide gear assembly caused by movement of the selector lever, said differential gearing means in a first position of said slide gear assembly rotating said front and rear wheels at high-speed and in a second position of said slide gear assembly rotating front and rear wheels at a low-speed;

(d) a winch mechanism driving power releasing means connected to the winch mechanism for releasing motive power from the winch mechanism when said winch mechanism excessively winds up a wire.

2. The motor-driven movable toy as set forth in claim 1, wherein:

said drive shaft is provided with a drive shaft spur gear (12) and a drive shaft pinion gear (11);

said differential gearing means including a differential gear casing (23) having a differential casing spur gear (26), said differential gear casing rotating two front wheels and two rear wheels;

said slide shaft (13) having a slide shaft spur gear (20) engaged with said drive shaft spur gear (12) and an inner gear (22) integrally formed with said spur gear (20);

a winch drive shaft (30) having a first winch drive shaft spur gear (31) and a second winch drive shaft spur gear (32); and said slide gear assembly (14) having a first slide gear pinion (16), a slide gear spur gear (15) and a second slide gear pinion (19); when said selector lever is set to high-speed toy driving operation, said slide gear assembly transmitting the motor power to said differential gear casing by way of the drive shaft spur gear (12), the slide shaft spur gear (20), the inner gear (22) of said slide shaft (13), the second slide gear pinion (19) and the differential casing spur gear (26); and when said selector lever is set to winch mechanism driving operation, said slide gear assembly transmitting the motor power to the winch mechanism by way of the drive shaft pinion gear (11), the slide gear spur gear (15) and the first slide gear pinion (16), the first winch drive shaft spur gear (31), and the second winch drive shaft spur gear (32).

3. The motor-driven movable toy vehicle as set forth in claim 2, wherein said winch mechanism driving-power releasing means (33) comprises:

(a) a hexagonal shaft (34);

(b) a winch drum (35) rotatable with said hexagonal shaft for rolling up or out a winch wire;

(c) a cylindrical member (39) having cutout (39*a*) and slope (39*b*) portions, said cylindrical member being slidable along said hexagonal shaft;

(d) a winch drive gear member (40) slidable along said hexagonal shaft so as to engage with or disengage from said second winch drive shaft spur gear (32), said gear member being formed with a smaller-diameter portion;

(e) a pair of rear-side and front-side semicircular control members (44, 45) having a cubic projection (45*c*), respectively; when said two control members are in slight contact with each other with the claws in contact with the slopes, the smaller-diameter portion of said winch drive gear member (40) being prevented from sliding along said hexagonal shaft to keep said winch drive gear member (40) in engagement with said second winch drive shaft spur gear (32); when said two control members are in pressure contact with each other with the claws running onto the slopes, the smaller-diameter portion of said winch drive gear member (40) being allowed to slide along said hexagonal shaft to guide said winch drive gear member (40) into disengagement from said second winch drive shaft spur gear (32); and (f) a slidable frame (50) having slopes (51*b*, 52*b*) and a projection (53), said slidable frame being urged toward said cylindrical member when the winch wire is excessively rolled-up for sliding said cylindrical member (39) and said winch drive gear member (40) with the slopes (51*b*, 52*b*) thereof in contact with the slopes (39*a*) of said cylindrical member and for urging said front-side control member (45) with said projection (53) thereof in contact with the dubic projection (45*c*) of said front-side control member, in such a way that said winch drive gear member (4) is brought into disengagement from said second winch drive shaft spur gear (32).

4. A motor-driven movable toy vehicle with a winch mechanism mounted thereon, which comprises:

(a) a toy body; a motor (7) mounted in said body;

(b) means mounted in said body connected to said motor for selectively driving said vehicle at high-speed or low-speed or for driving said winch mechanism, a selector means mounted in said body including a movably mounted selector lever (6) for selecting one of high-speed toy driving operation, low-speed toy driving operation and winch mechanism driving operation;

(c) said driving means including a drive shaft (9) driven by said motor, said drive shaft being provided with a drive shaft spur gear (12) and a drive shaft pinion gear (11);

(d) said driving means further including a differential gear casing (23) having a differential casing spur gear (26), said differential gear casing rotating two front wheels and two rear wheels;

(e) said driving means further including a slide gear shaft (13) having a slide gear shaft spur gear (20) fixed thereto engaged with said drive shaft spur gear (12) and an inner gear (22) integrally formed with said spur gear (20);

(f) said driving means further including a winch drive shaft (30) having fixedly mounted thereon a first winch drive shaft spur gear (31) and a second winch drive shaft spur gear (32); and (g) said driving means further including a slide gear assembly (14) rotatably and slidably mounted on said slide gear shaft having a first slide gear pinion (16), a slide gear spur gear (15) and a second slide gear pinion (19); said selector lever being positioned relative to said slidable gear assembly so that when said selector lever is set to high-speed toy driving operation, said slide gear assembly transmitting the motor power to said differential gear casing by way of the drive shaft spur gear (12), the slide gear shaft spur gear (20), the inner gear (22) of said slide gear shaft (13), the second slide gear pinion (19) of the slide gear assembly and the differential casing spur gear (26); when said selector lever is set to low-speed toy driving operation, said slide gear assembly transmitting the motor power to said differential gear casing by way of the drive shaft pinion gear (11), the slide gear spur gear (15), and the second slide gear pinion (19), and the differential casing spur gear (26); and when said selector lever is set to winch mechanism driving operation, said slide gear assembly transmitting the motor power to the winch mechanism by way of the drive shaft pinion gear (11), the slide gear spur gear (15) and the first slide gear pinion (16), the first winch drive shaft spur gear (31), and the second winch drive shaft spur gear (32).

5. A motor-driven movable toy vehicle provided with a winch mechanism as set forth in claim 4, which further comprises:

(a) a hexagonal shaft (34);

(b) a winch drum (35) rotatable with said hexagonal shaft for rolling up or out a winch wire;

(c) a cylindrical member (39) having cutout (39*a*) and slope (39*b*) portions, said cylindrical member being slidable along said hexagonal shaft;

(d) a winch drive gear member (40) slidable along said hexagonal shaft so as to engage with or disengage from said second winch drive shaft spur gear (32), said gear member being formed with a smaller-diameter portion;

(e) a pair of rear-side and front-side semicircular control members (44, 45) having a cubic projection (45*c*), a pair of slopes (44*a*) and a pair of claws (45*b*), respectively; when said two control members are in slight contact with each other with the claws in contact with the slopes, the smaller-diameter portion of said winch drive gear member (40) being prevented from sliding along said hexagonal shaft to keep said winch drive gear member (40) in engagement with said second winch drive shaft spur gear (32); when said two control members are in pressure contact with each other with the claws running onto the slopes, the smaller-diameter portion of said winch drive gear member (40) being allowed to slide along said hexagonal shaft to guide said winch drive gear member (40) into disengagement from said second winch drive shaft spur gear (32); and (f) a slidable frame (50) having slopes (51*b*, 52*b*) and a projection (53), said slidable frame being urged toward said cylindrical member when the winch wire is excessively rolled-up for sliding said cylindrical member (39) and said winch drive gear member (40) with the slopes (51*b*, 52*b*) thereof in contact with the slopes (39*a*) of said cylindrical member and for urging said front-side control member (45) with said projection (53) thereof in contact with the cubic projection (45*c*) of said front-side control member, in such a way that said winch drive gear member (40) is brought into disengagement from said second winch drive shaft spur gear (32).

* * * * *